US005614064A

United States Patent [19]

Nykopp

[11] Patent Number: 5,614,064

[45] Date of Patent: Mar. 25, 1997

[54] GLIDE-SHOE ARRANGEMEMT FOR PRESSING A MOVING WEB

[76] Inventor: Erik Nykopp, Larsbergsyägen 55, SE-181 38 Lidingö, Sweden

[21] Appl. No.: 392,773

[22] PCT Filed: Sep. 9, 1992

[86] PCT No.: PCT/SE92/00619

§ 371 Date: Feb. 24, 1995

§ 102(e) Date: Feb. 24, 1995

[87] PCT Pub. No.: WO94/05853

PCT Pub. Date: Mar. 17, 1994

[51] Int. Cl.[6] ..... D21F 3/02

[52] U.S. Cl. ..... 162/358.3; 162/361; 162/364; 100/153

[58] Field of Search ..... 162/358.3, 358.1, 162/358.2, 361, 364; 100/153, 154, 93 RP

[56] References Cited

U.S. PATENT DOCUMENTS

| | | | |
|---|---|---|---|
| 3,808,096 | 4/1974 | Busker et al. | 162/358.3 |
| 4,287,021 | 9/1981 | Justus | 162/358.3 |
| 4,431,045 | 2/1984 | Josefsson | 162/358.3 |
| 4,536,255 | 8/1985 | Justus | 162/358.3 |
| 5,011,578 | 4/1991 | Lange et al. | 162/358.3 |
| 5,043,046 | 8/1991 | Laapotti | 162/358.3 |
| 5,251,551 | 10/1993 | Abe et al. | 100/93 RP |
| 5,400,707 | 3/1995 | Neider et al. | 100/93 RP |

FOREIGN PATENT DOCUMENTS

| | | |
|---|---|---|
| 0389458 | 9/1990 | European Pat. Off. . |
| 9213134 | 8/1992 | WIPO . |

*Primary Examiner*—Donald E. Czaja
*Assistant Examiner*—Jose A. Fortuna
*Attorney, Agent, or Firm*—Dvorak and Traub

[57] ABSTRACT

The invention concerns a pressing arrangement for a moving web. The arrangement comprises a cylindrical roll forming a press zone with a glide-belt which is at least partially and slidingly supported by a shoe having a contour of alterable convexity along the press zone surface so as to alter the length of the press zone. Supply mechanisms are provided to supply lubricant for a lubricating film between the glide belt and the shoe. The shoe can be supported by a counter roll situated on the opposite side of the shoe relative the press roll and have a concave surface mating the counter roll thus enabling adjustment of the shoe around the centerline of the counter roll. In an alternative arrangement a desired press zone length could be obtained by installing a removable insert having a proper contour in the press zone area of the shoe.

8 Claims, 1 Drawing Sheet

GLIDE-SHOE ARRANGEMEMT FOR PRESSING A MOVING WEB

TECHNICAL FIELD

The present invention concerns a pressing or surface finishing arrangement for a moving web, comprising a cylindricaI roll which forms a press zone with a glide-belt supported by a shoe having a contour of variable convexity on the press zone surface so as to enable altering the length of the press zone and including lubricating means for obtaining a lubricating film between the glide-belt and the shoe.

TECHNICAL STAND

In prior art, a press arrangement is known thru International Application PCT/SE92/00041 wherein a shoe is under applied pressure via a glide-belt between a press roll and a counter roll, the shoe having a concave form following the contour of the press roll on the press roll side and a non-concave contour on the counter roll side and the shoe being adjustable around the centerline of the press roll so as to vary the pressure distribution in the contact zone with the press roll. The pressure zone on the counter roll side is however, not adjustable in any defined manner.

Further in prior art, a press arrangement is known thru U.S. Pat. No. 4,287,021 wherein a non-adjustable concave shoe is used to form a pressure zone with a press roll.

Examples of the general technical stand are also divulged thru EPO publications 0070869 and 0 389 458 A2.

DESCRIPTION OF THE INVENTION

One main purpose with the present invention is to achieve a pressing arrangement of the general type indicated in the introduction wherein the convexity of the shoe alone its pressing surface can be adjusted so as to always obtain a desired length of the pressing zone in the contact area with the press roll. This length is a function of the radius of the shoe in the contact area and can thus be altered by altering the degree of convexity of the shoe. By suitably pivoting the shoe in the present invention it can be adjusted to achieve a desired contour and length of press zone. The contour of the shoe in this area could suitably be spiral. Alternatively, a desired contour could be obtained by installing a removable insert in the press zone of the shoe. In practice the length of the press zone can be varied between approximately 1 and 26 centimeters when using a relatively hard press roll and more with a softer roll. Besides finding use in prose applications for removing water from a web, the present invention can be suitably applied in the smoothing of paper for improving the surface finish of the web. In the latter application the press roll is often heated to improve the web surface and thus in a preferred embodiment of the invention a counter roll on the opposite side of the shoe in relation to the press roll is used to lead off heat from the system via a concave pressure zone between the shoe and the counter roll.

BRIEF DESCRIPTION OF THE DRAWINGS

The invention shall now be elucidated in the following with reference to schematically illustrated arrangements on the attached drawings. Thus on the drawings

DESCRIPTION OF PREFERRED EMBODIMENTS

Figure 1:
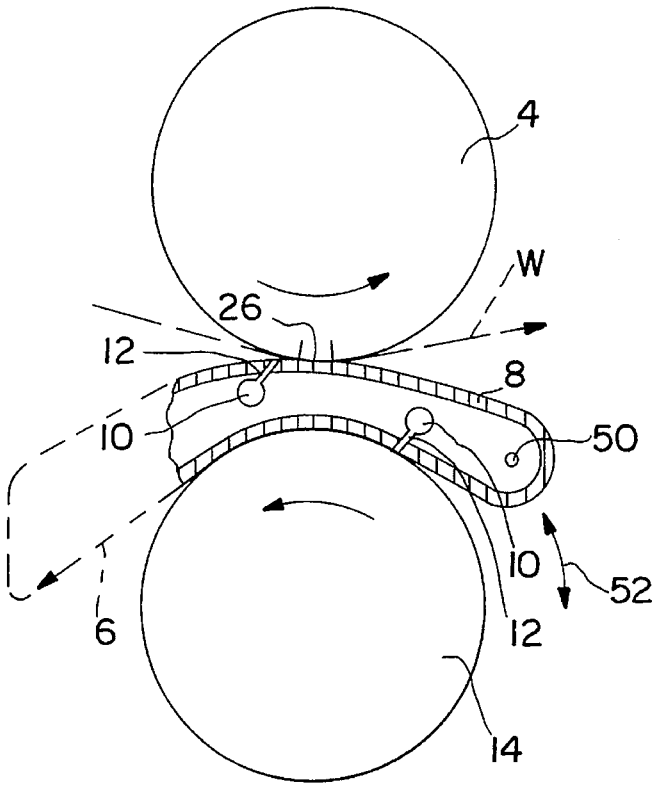
FIG. 1 is an endview of the embodiment of the invention as a crossection and partially illustrating an adjustable shoe.

In the drawings, identical reference numbers are used to indicate the same or similar details.

Figure 2:
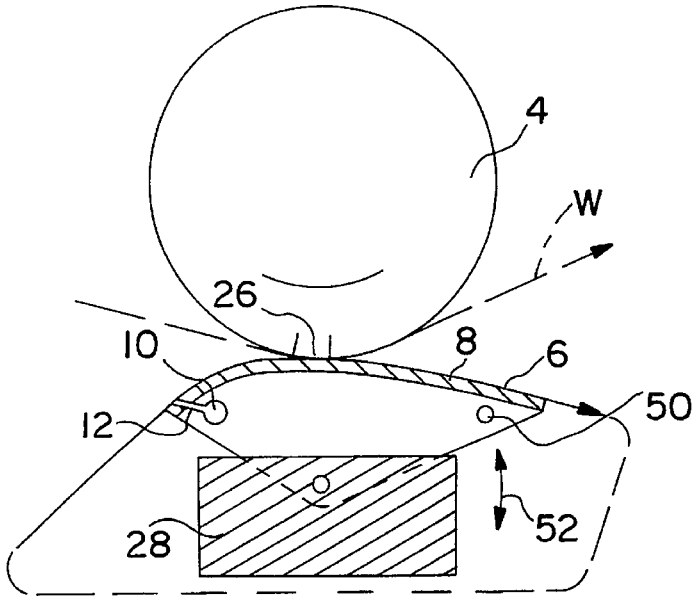
FIG. 2 is an endview of an alternative embodiment of the invention as a partial crossection.

FIGS. 1 and 2 show a pressing arrangement for a moving web, formed between a cylindrical press roll 4 and a glide-belt 6. The glide-belt is at least partially and slidingly supported on a shoe 8 which has a surface contour of varying convexity for forming the pressure zone. Supply mechanisms 10 are provided to supply lubricant for a lubricating film via canals 12 between the glide-belt 6 and shoe 8.

In FIG. 1 a counter roll 14 supports the shoe 8 having a concave contour mating the counter roll via the glide-belt 6 in the support area and being rotatably adjustable around the centerline of the counter roll to bring a desired section on the opposite side of the shoe into pressing contact with the press roll 4. The adjustability of the shoe 8 is schematically illustrated with arrow 52. This adjustment of the shoe can be realized in a manner not shown here by introducing forces on the endflanges 50. The adjustability of the shoe 8 makes it possible to optimize within limits the width of the pressure zone 26 between the press roll 4 and the shoe 8. The glide-belt can either be supported by the shoe along its entire length or alternatively mainly in the press area and guided by e.g. a roll or rolls along the rest of the path. The roll(s) which could also keep the glide-belt from wandering sideways and keep it stretched, constitute technology which is known in the art and is not shown here.

In FIG. 2 the counter roll 14 is replaced by a beam 28 on which the shoe 8 is pivotally mounted. The glide-belt 6 is guided around the beam by rolls etc not shown here.

Figure 3:
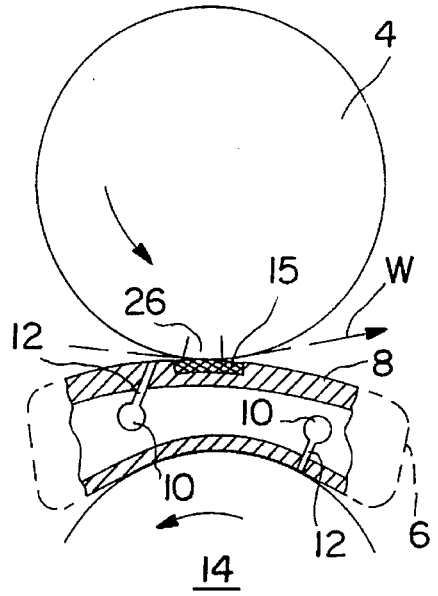
FIG. 3 is an endview of a partial crossection illustrating an insert in the shoe.

FIG. 3 shows an insert 15 in the shoe 8 in the area of the pressure zone 26 on the convex side. This insert is removable and has a curvature in the contact zone to conform with the desired length of the pressure zone 26. Installing another insert with a different curvature would thus alter the length of the pressure zone.

When practicaI solutions of details in the pressing arrangement according to the invention have not been described more comprehensively, they fall within known or customary practice in the art to which this invention pertains and are easily perceived by the expert.

The invention can be applied e.g. to improve the surface structure of a fibrous web such as paper and thereby the printability of paper or to remove water from a moving web in a papermachine, whereby the web is fed into the press zone in a conventional manner together with one or two felts which receive the water.

I claim:

1. A pressing arrangement for a moving web, comprising:

a press zone for receiving the moving web, said press zone formed between a cylindrical press roll and a glide-belt, which said glide-belt is at least partially and slidingly supported by and encloses a shoe, said shoe having a press roll side and an opposing counter roll side, whereby a plurality of supply mechanisms are provided to supply lubricant for creating a lubricating film between the glide-belt and the shoe, the shoe being supported by a counter roll, which said counter roll is situated on the opposite side of the shoe relative to the press roll (4), wherein the side of the shoe facing the press roll has a contour of variable convexity.

2. Pressing arrangement according to claim 1 characterized in that the counter roll (14) is a cooling roll.

3. The pressing arrangement according to claim 1, wherein the contour of the shoe towards the counter roll is concave, said contour accompanying the surface of the counter roll in the contact area and wherein the shoe is adjustably mounted around the centerline of the counter roll.

4. The pressing arrangement according to claim 3, wherein the counter roll is a cooling roll.

5. A pressing arrangement for a moving web, comprising a press zone for receiving the moving web, said press zone formed between a cylindrical press roll and a glide-belt, said glide-belt being endless and slidingly supported by a shoe in the area of the press zone, whereby a plurality of supply mechanisms are provided to supply lubricant for creating a lubricating film between the glide-belt and the shoe, the shoe being supported from a beam, which said beam is situated on the opposite side of the shoe relative to the press roll, wherein the side of the shoe facing the press roll has a non-concave contour.

6. The pressing arrangement according to claim 5, wherein the contour of the shoe facing the roll has a contour of variable convexity and is adjustably mounted so as to obtain a desired width of the press zone.

7. A pressing arrangement for a moving web, comprising a press zone receiving the moving web, said press zone formed between a cylindrical press roll and a glide-belt, said glide-belt being endless and slidingly supported by a shoe in the area of the press zone, said shoe having a press roll side and an opposing counter roll side, whereby a plurality of supply mechanisms are provided to supply lubricant for creating a lubricating film between the glide-belt and the shoe, the shoe being supported by a counter roll situated on the opposite side of the shoe relative to the press roll, wherein the side of the shoe facing the press roll has a contour of variable convexity, and said shoe contains a removable insert having a defined contour in the area of the press zone, said insert configured to conform to said curvature of said press roll and to define a length of said press zone, whereby the convexity of said guide-belt in said press zone is determined by said curvature of said shoe.

8. Pressing arrangement according to claim 7, characterized in that the counter roll is a cooling roll.

* * * * *